United States Patent [19]

Neville

[11] 3,972,438

[45] Aug. 3, 1976

[54] FURNITURE FORMING SYSTEM

[76] Inventor: Gary J. Neville, 1644 - 20th St., Santa Monica, Calif. 90404

[22] Filed: Apr. 10, 1975

[21] Appl. No.: 566,989

[52] U.S. Cl. ..... 220/4 R; 220/23.83

[51] Int. Cl.[2] ..... B65D 7/00; B65D 21/02

[58] Field of Search ..... 220/4 R, 4 A, 4 C, 5 R, 220/85 R, 20, 23.83, 23.86; 108/90, 26, 14, 11

[56] References Cited

UNITED STATES PATENTS

| | | | |
|---|---|---|---|
| 2,326,414 | 8/1943 | Thompson | 220/4 R |
| 3,115,281 | 12/1963 | Somme | 220/5 R X |
| 3,485,408 | 12/1969 | Benesch | 220/4 C |
| 3,708,085 | 1/1973 | Bumpas | 220/4 R X |

*Primary Examiner*—George E. Lowrance
*Assistant Examiner*—Steven M. Pollard
*Attorney, Agent, or Firm*—Herzig & Walsh, Incorporated

[57] ABSTRACT

A construction technique particularly adapted for constructing furniture. The construction embodies a limited number of modular elements preferably fabricated by a spun metal technique, that is, spinning. The preferred modular elements include flanged tub-like members that can be assembled in a column, the elements opening either upwardly or downwardly. A further basic modular element of toroidal shape is provided and with which a column can be capped to form a dual environment planter having a central main cavity and a perimetrical shallow cavity. The torus element can support a flat platform member to form a table top. A further modular member is provided, which is a smaller member with an opening for providing a single environment planter. This member also can receive a flat platform to form a table. The modular members as described are adapted to construction of a large number of structural units of different shapes and sizes.

7 Claims, 12 Drawing Figures

FIG. 1
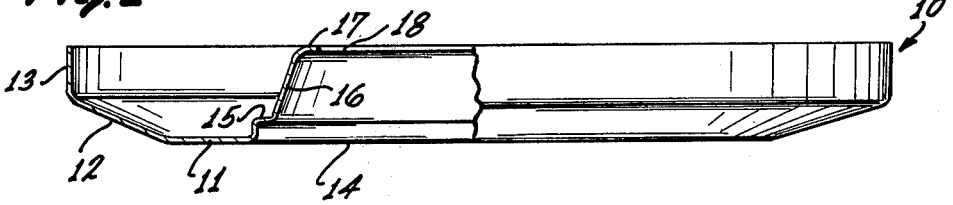
FIG. 5
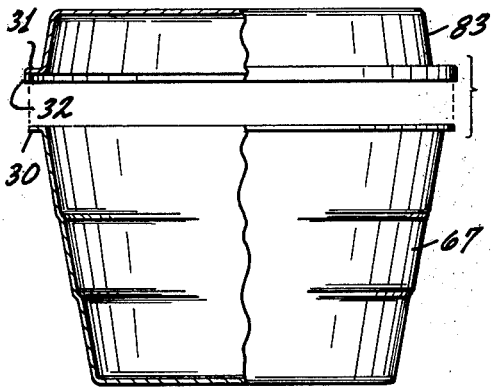
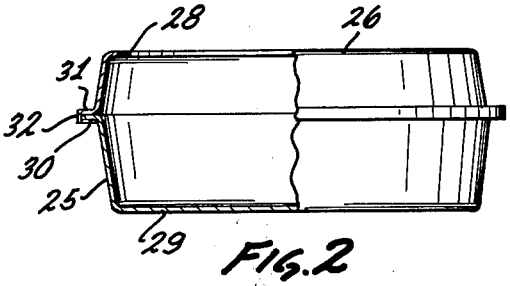
FIG. 2
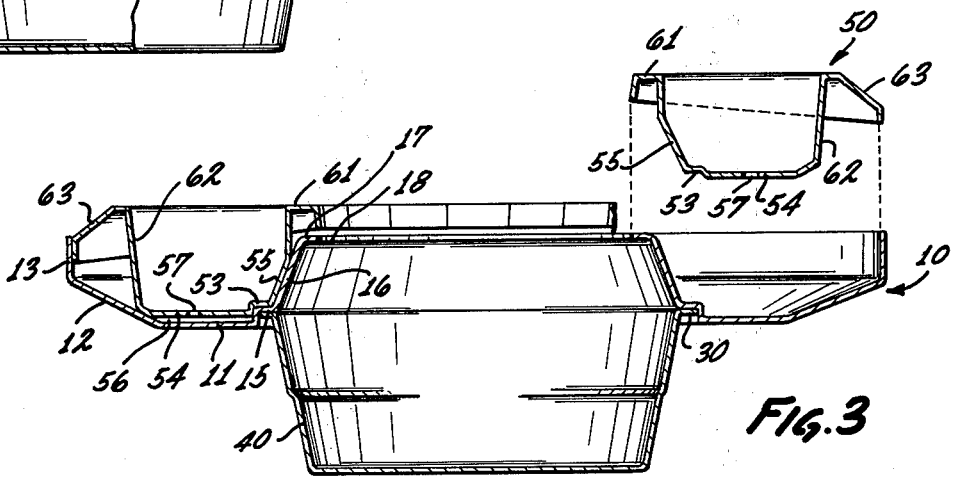
FIG. 3
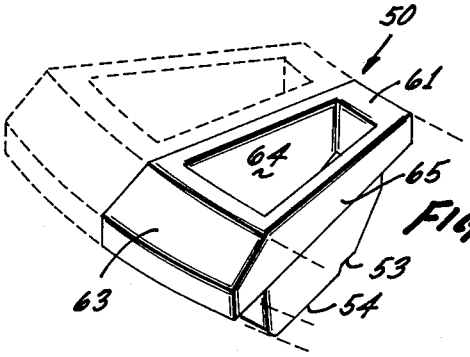
FIG. 3a
FIG. 6
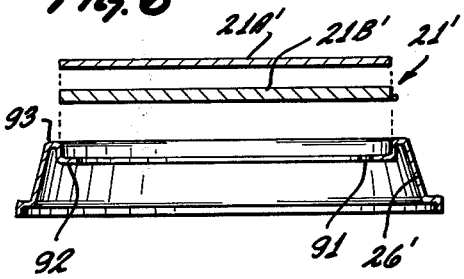

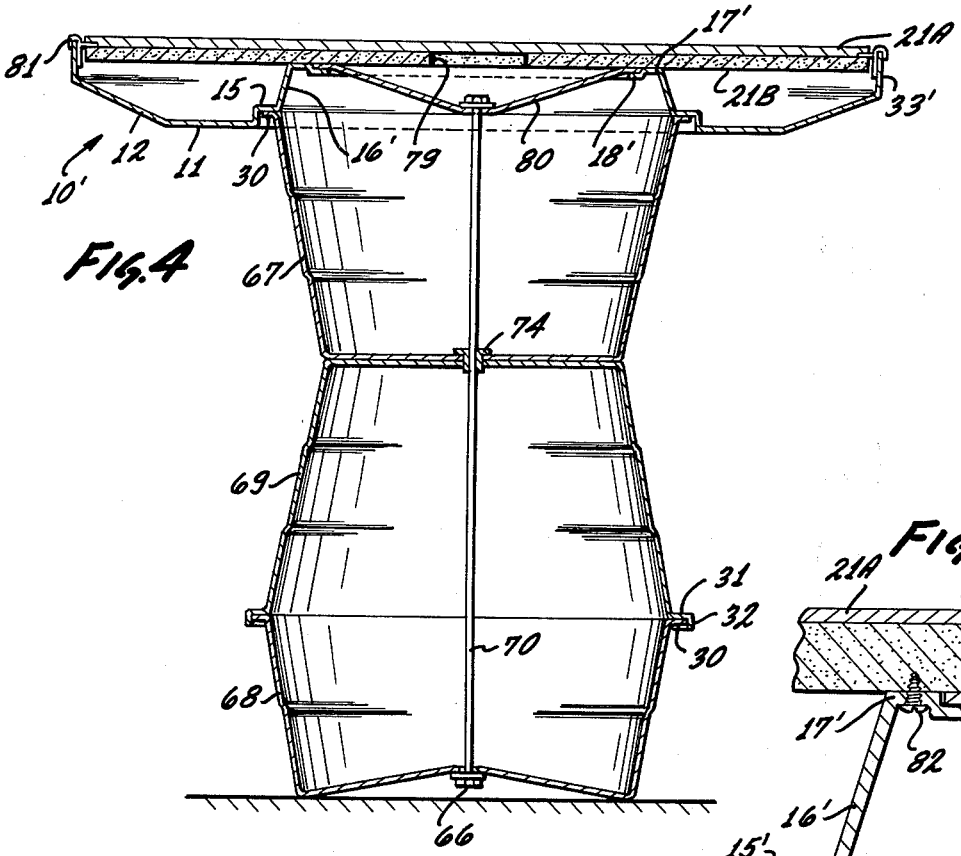
FIG. 4
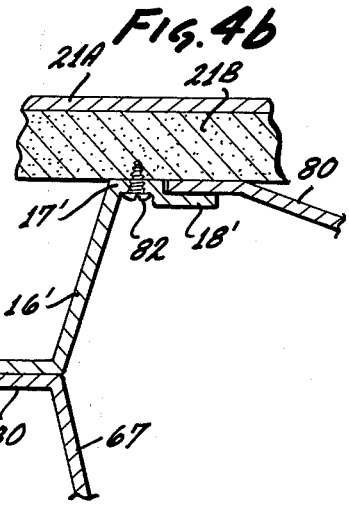
FIG. 4b
FIG. 4a
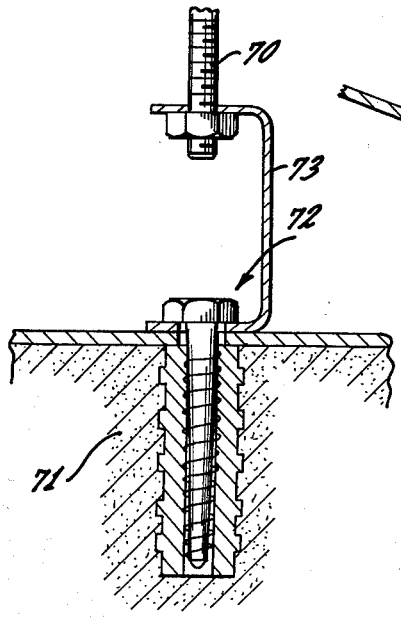
FIG. 4c
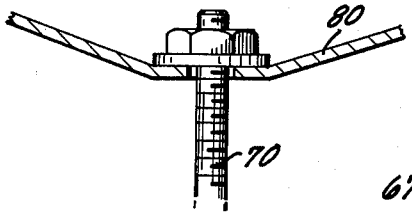
FIG. 4d
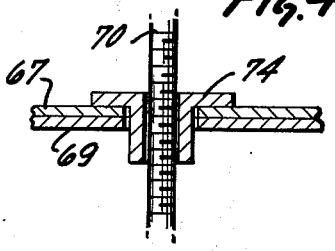
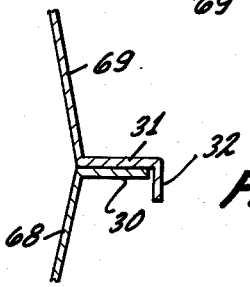
FIG. 4e

FURNITURE FORMING SYSTEM

BACKGROUND OF THE INVENTION

1. Field of the Invention

The field of the invention relates to the design and technique of fabricating rigid structural articles from a limited number of modular elements or members of particular design adapted to the purpose. The invention is particularly adapted to the construction of articles of furniture, using the new and unique concepts and principles of the invention.

2. Description of the Prior Art

The concept and techniques of the invention are entirely unique for the purpose. A search has revealed U.S. Pat. Nos. 3,058,263 and 3,257,024, which are not considered closely relevant.

SUMMARY OF THE INVENTION

The foregoing abstract illustrates generally the nature of the invention. In the preferred form of the invention, there may be five basic modular elements from which a large number of articles of different shapes and different sizes can be assembled.

In the exemplary form of the invention described herein, the modular elements or members are circular members of metal, fabricated by the process of spinning. The modular elements or members could, however, be fabricated by other processes. The basic modular elements may comprise circular tub-like members of various heights or depths provided with a peripheral flange for assembling in a column with the opening in the member either facing up or down, as will be described in detail hereinafter.

One of the basic modular elements is a form of torus ring having a central opening, and this member is preferably adapted for capping a column formed by others of the modular elements. The torus ring is highly adapted for formation, as referred to in the foregoing, of a dual environmental planter or table or otherwise.

A significant aspect of the invention is that the basic shapes or modules can be fabricated by using simplified tooling, that is, a simplified die, it being possible to form different of the modular members using the same die or a minor modification of it.

In the light of the foregoing, it is a primary object of the invention to provide an entirely new technique and means for fabricating furniture articles, such as planters, tables, etc.

A further object is to make available a construction technique as referred to in the foregoing wherein a limited number of basic modular members such as five is provided, the members having such construction and relationship to each other, that they can be assembled in different ways to form a large number of different articles having different shapes and sizes. A corollary object is to achieve the purpose economically as to tooling, fabrication process, and amount of material used.

A further object is to provide a technique as described wherein the modular elements or members include a torus ring having a central opening and circular tub members of varying heights adapted for assembly with each other into column form, the torus ring being constructed and adapted to form a cap for such a column.

A further object is to provide modular members adapted for assembly as described into articles such as planters and/or tables and the like.

Further objects and additional advantages of the invention will become apparent from the following detailed description and annexed drawings wherein:

FIG. 1 is a sectional view of a basic modular member in the form of a torus ring having a central opening;

FIG. 2 is a view partly in section showing a basic shape or member in the form of an open-topped ring member assembled on a member in the form of a tub having a peripheral flange;

FIG. 3 is a sectional view showing a slightly modified form of the torus ring of FIG. 1 adapted for use as a planter, the ring being capped on one of the tub-like modular members;

FIG. 3*a* is a detail view showing plastic formed insert members that are inserted into the outer cavity of the torus ring for holding earth or other material in a planter;

FIG. 4 is a cross-sectional view of an assembly of a column as identified in the foregoing capped with a slightly modified form of torus ring member and fitted with a solid platform member to form a table;

FIGS. 4*a* through 4*e* are views of details of the construction shown in FIG. 4;

FIG. 5 is a sectional view of a three-diameter tub with flange and assembled at the top with an inverted single diameter tub member.

FIG. 6 is a sectional view of a form of the article of FIG. 2 modified to receive a table top.

DESCRIPTION OF PREFERRED EMBODIMENTS

Referring to FIG. 1, an upwardly opening toroidal shaped basic member 10 is there shown. The member 10 has a flat bottom portion 11 which is interconnected by an upwardly sloping portion 12 with an upwardly extending annular outer periphery 13. The annular outer peripheral part 13 is concentric with the axis of the member 10 and the bottom portion 11 is illustrated extending perpendicularly to the surface 13.

Formed in an upwardly recessed position around the opening 14 defined by the bottom portion 11 is ledge or flange structure 15. The ledge or flange structure 15 is illustrated extending parallel with the bottom portion 11. Extending upwardly from the inner edge of the ledge 15 is an inwardly sloping conical portion 16 which terminates on its upper end with an inwardly extending cylindrical flange 17. The flange 17 defines a circular opening 18 and is illustrated extending parallel to ledge 15. This basic shape is preferably formed by metal spinning using a simplified tooling, that is a die which provides the profile of the wall of the central opening. This shape or member can be suspended as a planter or assembled as described hereinafter.

There is shown in FIG. 2 a planter formed by assembling an upwardly opening tub-like member 25 with a downwardly opening tub-like member 26. Member 26 is a basic module member. Its profile in section is like that of the wall of the central opening 18, FIG. 1. It has center opening 28.

The upwardly opening tub-like member 25 has a flat base surface 29 which extends substantially perpendicularly to its longitudinal axis. The base surface 29 is for placement on a ground or floor surface. The tub 25 narrows downwardly, and as is illustrated in FIG. 2 is made up of a single annular section. Formed around the upper edge of the tub 25 is a circular flange 30 which extends substantially perpendicularly to the tub's longitudinal axis.

The downwardly opening tub member 26 is illustrated as formed of one substantially annular section and has an open top. Formed around the lower edge of the tub 26 is a circular flange 31 extending perpendicular to the tub's longitudinal axis. A rim or lip 32 is formed on the flange 31 to extend perpendicularly downwardly therefrom.

As shown in FIG. 2, the inner diameters of the upper and lower edges of the tub 25 and 26, respectively, are substantially equal, while the flange 31 and the diameter of the annulus defined by the rim 32 is slightly larger than the outer diameter of the flange 30. Thereby, the tub 26 fits on the upper edge of the tub 25 with the flanges 30 and 31 held in stable contact with each other by the rim 32 by gravity. It is noted that the engagement between the flange 31 and rim 32 is preferably a smooth surface so that sharp edges are not present upon which a person could be cut.

A planter is shown formed in FIG. 3 by assembling a tub-like member 40 with a toroidal shaped member 10. Tub 40 is like tub 25 except that it is a "two diameter" tub.

Numeral 50 designates a planter insert as illustrated in FIG. 3*a*. It is fitted within the upwardly opening peripheral annular cavity, defined by the member 10. It is noted that the wall 16 and ledge or shoulder structure 15 and rim 51 operate to hold the toroidal shaped member 10 stably in place on the tub 40 by fitting around the flange 30 to prevent lateral movement. The rim portion 51 extends substantially perpendicular to the ledge or flange 15.

The planter insert 50 has a bottom portion 54 and is formed on its inner periphery at 53 and 55, respectively, to mate flush with the ledge structure 15 and sloping portion 16 so as to be held in a spaced apart position above the bottom 11 of the toroidal shaped member 10. Thereby, a space 56 is defined into which water may drain through the holes 57 formed in the insert bottom, and collect in the space 56.

The planter insert 50 has an inclined wall 55 as described, a part of which is complementary to the conical surface 16 to hold the insert against lateral movement and the remainder of which extends upwardly and then curves downwardly to define the inner and upper perimeter 61 of the insert 50. The insert 50 also has outer wall 62 which curves outwardly and downwardly to define the outer perimeter 63 of the planter insert. The outer lower edge 63 of the wall 62 fits within the annular wall 13 of the toroidal member 10.

The sides of insert 50, as designated 64 and 65 are along radii so that a plurality of the inserts can be positioned side by side in a circle as illustrated in FIG. 3*a*.

It is noted that one suitable dimension for the toroidal member 10 is approximately 39 inches in diameter and 4 inches in depth. The components of the assembled planter may be made of any suitable material, such as spun aluminum, steel, plastic, and/or fiberglass.

Referring to FIGS. 4-4*e* there is shown a table formed in accordance with the present invention. A modified form of toroidal shaped member identified by the numeral 10' is positioned on the upper end of the uppermost tub 67. Parts of the member 10', corresponding to those of the member 10, are identified by the same numerals. Member 10' is like 10 except that the inner wall 16' around the center opening has slightly less depth. The member 10' has its shoulder structure 15, which is dimensioned to fit over and mate with the flange 30, and positioned to rest on the flange 30. The column or pedestal of the table is formed by two tub-like members 67 and 68 with a tub-like member 69 secured therebetween. The tubs 68 and 69 are held in alignment by the engaging flanges 30 and 31 and rim 32 and in axial stability by tension member 70 which extends through holes in the tubs 67 and 69 and is held by a nut 66 under tub 68. See FIG. 4*e* and FIG. 4.

The upper flange 17' is recessed forming inner flange 18' to receive a concave tension crown cap 80. The upper end of the tension member 70 is bolted to the crown cap 80 through access hole 79 as will be described, as shown in FIG. 4, so that the crown 80 may be drawn toward the lowermost tub 68 to hold the tubs 67–69 and member 10' tightly together as a column. See the detail view, FIG. 4*b*. The flat periphery of the crown cap 80 is between flange 17' and member 21B.

The lowermost tub 68 may be anchored to a ground surface 71 by an anchor bolt arrangement 72, as shown in FIG. 4*a*. A channel member 73 is secured by the bolt arrangment 72 on the bottom of this tub 68 as shown in FIG. 4*a*. The tension member 70 is bolted to the upper end of the channel member 73 and extends upwardly therefrom. .

Numeral 74 designates a bushing. The bushing 74 defines a continuous hole through the top (bottom) of the tub 69 and the bottom of the uppermost tub 67. The bushing 74 cooperates with the tension member 70 to form a slip joint, and prevents lateral movement of the tubs relative to each other. The bushing increases the bearing surface against metal of the tubs, thus reducing stresses under lateral load forces.

The outer wall 33' of the toroidal member 10' also extends the same height as in FIG. 3. The inner peripheral wall portion 16' is lowered so that the circular top members 21A and 21B can be fitted therein. A hook-shaped gasket 81 is shown positioned around the outer edges of the top members 21 for closing the space between the edges and the annular wall 33' while covering over this upper edge for safety. Member 21A may be a mirror. The top member 21B preferably is made of particle board or a similar material and is secured to the toroidal member 10' by screws 82, as shown in FIG. 4*b*.

FIG. 5 shows a table formed by a tub 67 and inverted tub 83 assembled like FIG. 2, tub 83 not having an opening, but otherside being similar to member 26.

Referring to FIG. 6, a modified form of tub 26' is there shown which is similar to member 26 but has its upper end formed as an annular recess 91 for receiving a planar top member 21'. The top member 21' is illustrated as formed by two similarly sized superimposed circular planar members 21A' and 21B'. The members 21A' and 21B' are, respectively, a mirror and rigid member or optionally with only the mirror. The top members 21' are dimensioned to fit within the annular opening 91 and rest upon the inwardly extending circular flange 92. The flange 92 is illustrated as extending perpendicularly to the longitudinal axis of the tub 26' and is downwardly recessed a distance approximately equal to the depth of the superimposed members 21. Thereby, the members 21 when positioned in the annular opening 91 extend substantially flush with the upper edge 93 of the opening 91. It is noted that the parts of the tub 26' corresponding to those of of previously described tubs are identified by the same numerals with a prime added.

It is noted that various pieces of furniture of different shapes and sizes may be constructed by using the modular system of the present invention. Toroidal shaped members as described herein can be suspended as hanging planters. Many of the components of the modular system described herein are further capable of being nested one within the other during transporting thereof.

It is to be understood that the foregoing disclosure is exemplary of the modules and the structures that can be assembled from them. The same principle may be applied in arriving at other structures as suggested by the following representative examples which are integral to the disclosure herein. The module of FIG. 6 may be capped on one or more of the other modules. More or less modules may be used in the column of FIG. 4. Any module shown as a top or cap module may be superimposed on any of the other modules.

Although I have herein shown and described my invention in what I have conceived to be the most practical and preferred embodiments, it is recognized that departures may be made therefrom within the scope of my invention.

What is claimed is:

1. In the art of construction of a rigid article such as furniture in combination, a group of three-dimensional modular members, at least one of said members having a bottom and sides and an upper part, including an extending flange structure, a second one of said members being constructed to be received and retained on said first member, said second member having a part configurated to interfit with the extending flange on the said one member whereby the members are held against relative lateral displacement, said one member being in the form of a circular tub having the extending flange at the periphery of its upper edge, said second member having a central open topped opening and being constructed to have an open topped peripheral cavity formed to receive open topped plant containers.

2. In the art of construction of a rigid article such as furniture in combination, a group of three-dimensional modular members, at least one of said members having a bottom and sides and an upper part, including an extending flange structure, a second one of said members being constructed to be received and retained on said first member, said second member having a part configurated to interfit with the extending flange on the said one member whereby the members are held against relative lateral displacement, said one member being in the form of a circular tub having the extending flange at the periphery of its upper edge, said second member having a central open topped opening and being constructed to have an open topped peripheral cavity formed to receive open topped plant containers, said first member having a taper between its top and bottom having sections of different diameter with a shoulder between sections of different diameter.

3. A construction as in claim 2, including a plurality of open-topped inserts positioned in said peripheral cavity.

4. In the art of construction of a rigid article such as furniture in combination, a group of three-dimensional modular members, at least one of said members having a bottom and sides and an upper part, including an extending flange structure, a second one of said members being constructed to be received and retained on said first member, said second member having a part configurated to interfit with the extending flange on the said one member whereby the members are held against relative lateral displacement, said second member having a bottom, sides, and an upper part, one of said members being inverted with the bottoms of said members juxtaposed together and means extending axially holding the members in assembled relationship.

5. A construction as in claim 4 including a further element in the form of a crown piece resting on peripheral edges of said wall part and having engagement with said axial element.

6. In the art of construction of a rigid article such as furniture in combination, a group of three-dimensional modular members, at least one of said members having a bottom and sides and an upper part, including an extending flange structure, a second one of said members being constructed to be received and retained on said first member, said second member having a part configurated to interfit with the extending flange on the said one member whereby the members are held against relative lateral displacement, said second member having a bottom, sides, and an upper part, one of said members being inverted with the bottoms of said members juxtaposed together and means extending axially holding the members in assembled relationship, including a further element in the form of a crown piece resting on peripheral edges of said wall part and having engagement with said axial element, and including a third member having the shape of a torus ring having a central opening with the wall around the central opening, the third member being capped on the first and second members.

7. A construction as in claim 6, wherein said inside wall of the torus member has an annular shoulder sized to fit over and rest on a peripheral flange on a second member.

* * * * *